US008109796B2

(12) United States Patent
Chen

(10) Patent No.: US 8,109,796 B2
(45) Date of Patent: Feb. 7, 2012

(54) ELECTRICAL CONNECTOR WITH ELASTIC LEAD SECTIONS

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 28 days.

(21) Appl. No.: 12/824,249

(22) Filed: Jun. 28, 2010

(65) Prior Publication Data

US 2010/0330847 A1 Dec. 30, 2010

(30) Foreign Application Priority Data

Jun. 26, 2009 (CN) ..... 2009 2 0305133

(51) Int. Cl.
*H01R 24/00* (2011.01)

(52) U.S. Cl. ..... 439/660

(58) Field of Classification Search ..... 439/660, 439/291, 357, 79, 947, 607.01, 329, 607.04, 439/638

See application file for complete search history.

(56) References Cited

U.S. PATENT DOCUMENTS 6,716,068 B2 4/2004 Wu
7,726,982 B2 * 6/2010 Ngo ..... 439/79
7,731,535 B1 * 6/2010 Wan et al. ..... 439/607.4
2009/0186528 A1 * 7/2009 Chen ..... 439/660
2010/0035476 A1 * 2/2010 Wu ..... 439/638

* cited by examiner

*Primary Examiner* — Jean F Duverne

(74) *Attorney, Agent, or Firm* — Wei Te Chung; Andrew C. Cheng; Ming Chieh Chang

(57) ABSTRACT

An electrical connector includes an insulative housing and a pair of contacts. The insulative housing defines a mating face, a rear face opposite to the mating face, and a receiving cavity between and running through the mating face and the rear face. The contacts are retained in two opposite sides of the receiving cavity and each defining a contacting portion, a retaining portion extending backward from the contacting portion and at least a terminal portion extending from the contacting portion. A pair of elastic pieces integrally extend backward from the mating face of the insulative housing to the receiving cavity and free ends of the contacting portions resist on the elastic piece. The elastic pieces shift away from the receiving cavity under a condition that a mating electrical connector is inserted in the receiving cavity and press against the elastic pieces. The contacts are wider than the elastic pieces.

6 Claims, 4 Drawing Sheets

ELECTRICAL CONNECTOR WITH ELASTIC LEAD SECTIONS

BACKGROUND OF THE INVENTION

1. Field of the Invention

The present invention relates to an electrical connector, and more particularly to an electrical connector with elastic lead sections to smoothly guide an insertion of a mating electrical connector.

2. Description of the Related Art

U.S. Pat. No. 6,716,068 issued to Jerry Wu on Apr. 6, 2004 discloses a conventional electrical connector. The electrical connector comprises an insulative housing and a plurality of contacts respectively retained in the insulative housing. The insulative housing defines a longitudinal slot inserted by a mating electrical connector and a plurality of passageways arranged at one side of the slot and communicating with the slot to receive said contacts. The passageways run through a front face of the insulative housing and each has a pre-loading portion integrally formed with the insulative housing so that the passageways are of hole shaped at the front face. Each contact defines a contacting portion protruding into the slot and a front free end slantwise resisting on the pre-loading portion to facility of the insertion of the mating electrical connector. The per-loading portion will occupy a height of the whole electrical connector.

In view of the above, a new electrical connector that overcomes the above-mentioned disadvantages is desired.

SUMMARY OF THE INVENTION

Accordingly, an object of the present invention is to provide an electrical connector with elastic lead sections to smoothly guide an insertion of a mating electrical connector.

To fulfill the above-mentioned object, an electrical connector comprises an insulative housing and a pair of contacts. The insulative housing defines a mating face, a rear face opposite to the mating face, and a receiving cavity between and running through the mating face and the rear face. The contacts are retained in two opposite sides of the receiving cavity and each defining a contacting portion, a retaining portion extending backward from the contacting portion and at least a terminal portion extending from the contacting portion. A pair of elastic pieces integrally extend backward from the mating face of the insulative housing to the receiving cavity and free ends of the contacting portions resist on the elastic piece. The elastic pieces shift away from the receiving cavity under a condition that a mating electrical connector is inserted in the receiving cavity and press against the elastic pieces. The contacts are wider than the elastic pieces.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
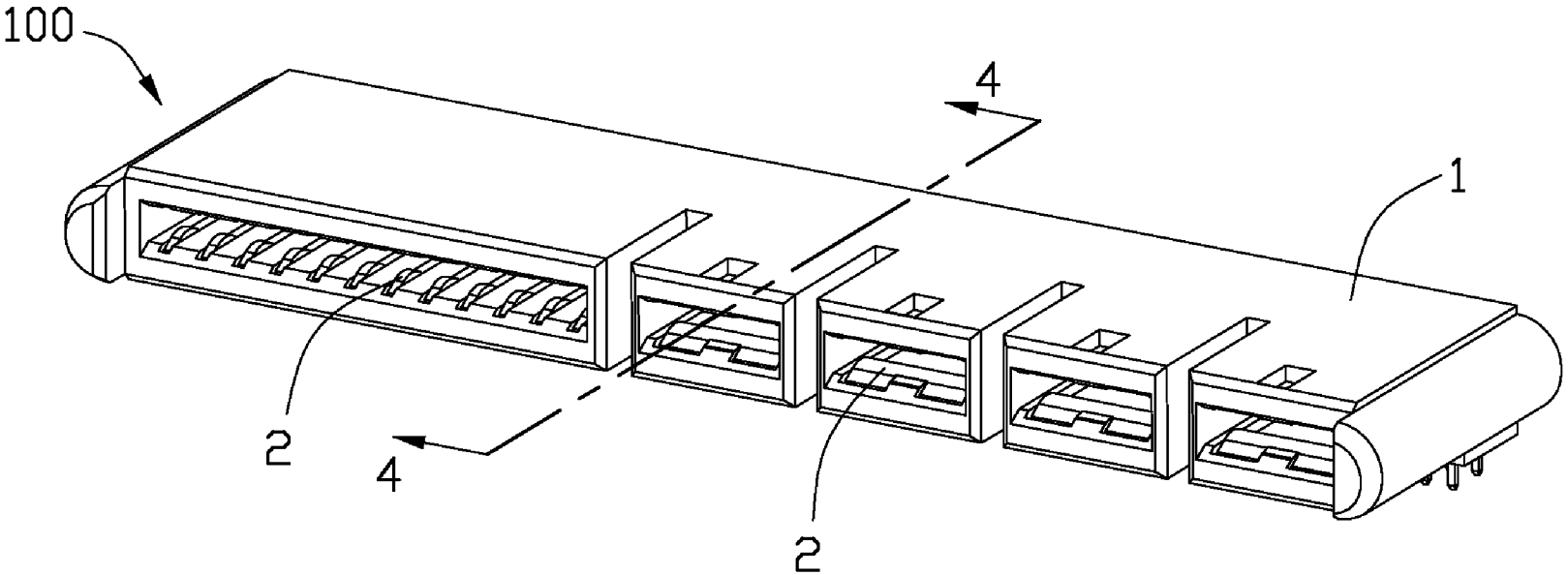
FIG. 1 is a perspective view of an electrical connector of the present invention.

Referring to FIG. 1, an electrical connector 100 includes an insulative housing 1 and a plurality of contacts 2 assembled in the insulative housing 1.

Figure 2:
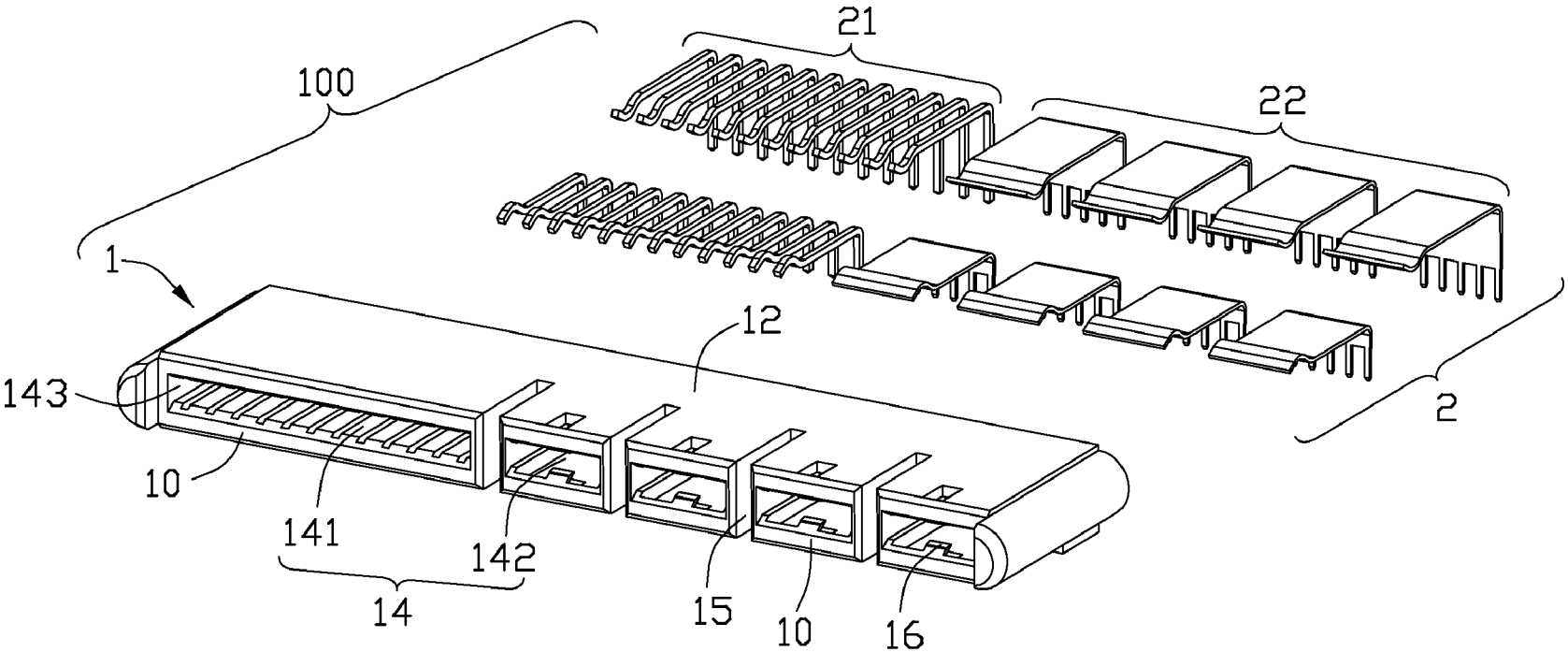
FIG. 2 is a top and front, exploded view of the electrical connector of FIG. 1.
Figure 3:
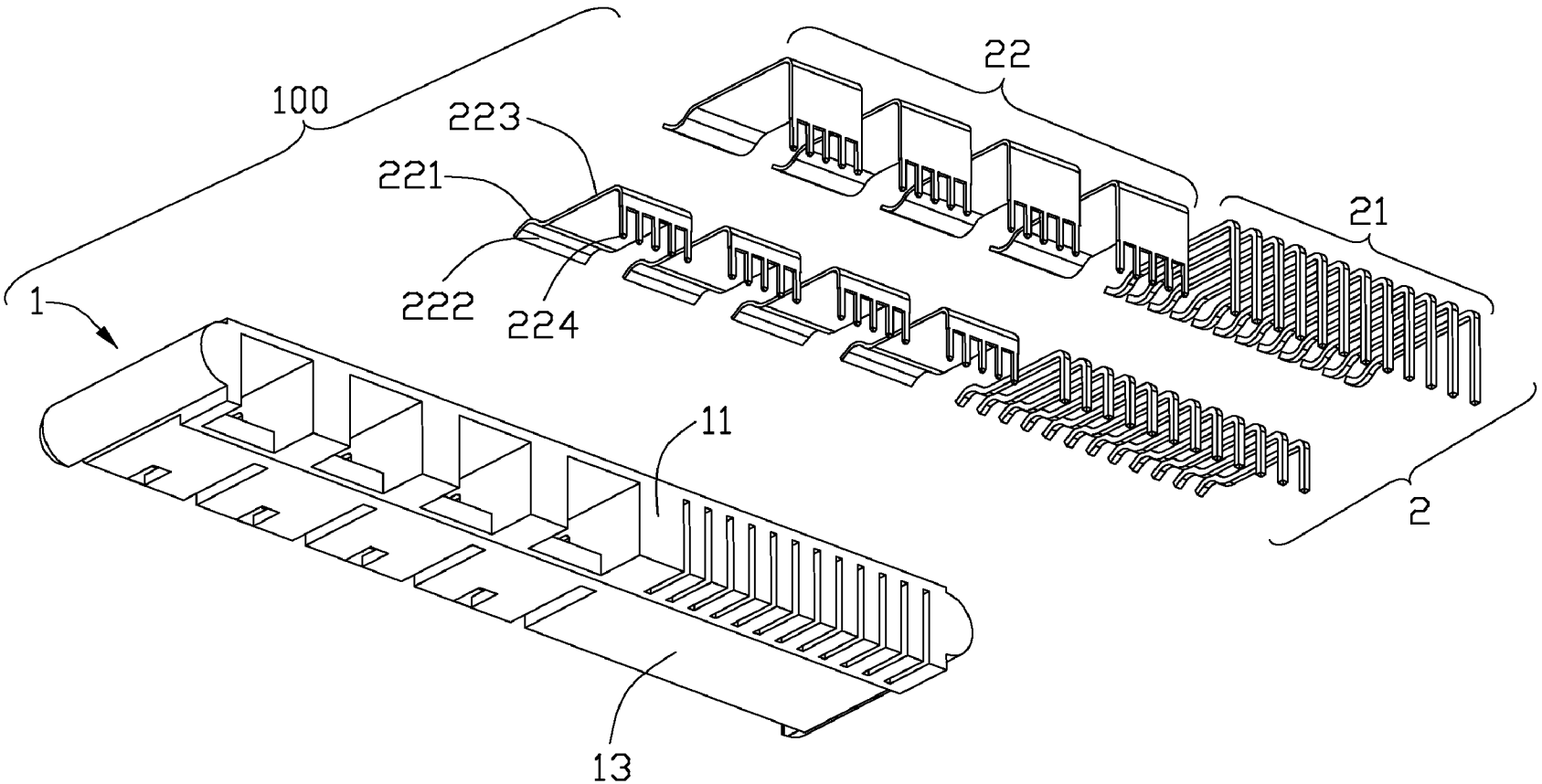
FIG. 3 is a bottom and rear, exploded view of the electrical connector of FIG. 1.

Referring to FIGS. 2-3, the insulative housing 1 is configured with a rectangle manner. The insulative housing 1 defines a mating face 10, a rear face 11 opposite to the mating face 10, and a top wall 12 and a bottom wall 13 bridging the mating face 10 and the rear face 11. Said faces 10, 11, 12, 13 jointly define a plurality of receiving rooms 14 divided by a plurality of partition grooves 15. The partition grooves 15 extend backward from the mating face 10 and run through the top wall 12 and the bottom wall 13. The receiving rooms 14 run through the mating face 10 and form a plurality of inserting opening 143 through which a plurality of mating electrical connectors (not shown) are inserted into the receiving rooms 14. The receiving rooms 14 include signal receiving cavities 141 and power receiving cavities 142. As shown in this embodiment, the electrical connector 100 includes one signal receiving cavity 141 and four power receiving cavities 142. Each power receiving cavity 142 defines a pair of elastic pieces 16 respectively extending from a front edge of the top wall 12 and the bottom wall 13. The two elastic pieces 16 extend backward from the middle of the mating face 10 to the power receiving cavity 142 and reach a point closest to each other to lead the mating electrical to be inserted into power receiving cavities 142. A front end 161 of the elastic piece 16 integrally extends from the housing 1, and a free rear end 162 slants into the receiving cavity 142 and is movable in an up-to-down direction so that the elastic piece 16 can be pressed not to occupy the height of the power receiving cavity 142 and the mating electrical connector can be inserted into the housing 1 smoothly. The free rear end 162 of the elastic piece 16 are projecting into the power receiving cavity 142 further compared with the front end 161 of each elastic piece 16.

The contacts 2 are inserted into the housing 1 in a rear-to-front direction and include signal terminals 21 and power terminals 22. The signal terminals 21 are arranged in two rows in the up-to-down direction. The two rows of signal contacts 21 are respectively retained to inner faces of the top wall 12 and the bottom wall 13 of the signal receiving cavity 141. The power terminals 22 are also arranged in two rows in the up-to-down direction. The two rows of power contacts 22 are also respectively retained to inner faces of the top wall 12 and the bottom wall 13 of the power receiving cavity 142. Several signal contacts 21 in two rows are retained in one signal receiving cavity 141. Each power receiving cavity receives a pair of power contacts 22 retained to the top wall 12 and the bottom wall 13.

Figure 4:
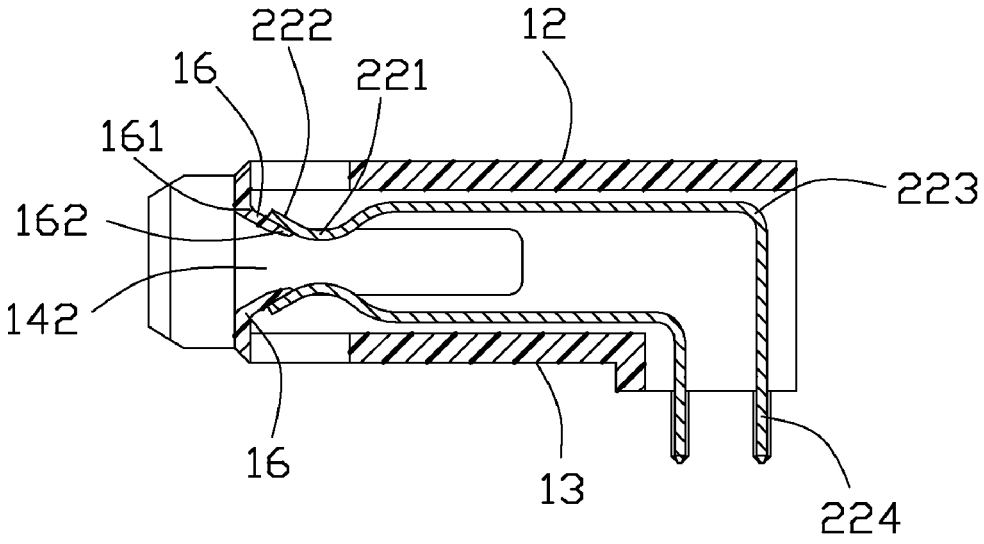
FIG. 4 is a cross sectional view of the electrical connector taken along 4-4 in FIG. 1.

Each power contact 22 is configured with a plate manner and defines a contacting portion 221, a retaining portion 223 extending levelly from the contacting portion 221 and a plurality of terminal portions 224 extending from the retaining portion 223 for soldering. The terminal portions 224 of two power contacts 22 in a power receiving cavity 142 are in two rows in a front-to-rear direction and the terminal portions 224 are perpendicular with the contacting portions 221. The contacting portion 221 is configured with arc-shaped and movable in the up-to-down direction. Referring to FIG. 4, a free end 222 of the contacting portion 221 resists on an inner side of the rear end 162 of the elastic piece 16 close to the corresponding inner wall of the receiving cavity 142. The contacts 2 are wider than the elastic pieces 16. When the mating electrical connector is inserted into the power receiving cavity 142, the mating electrical connector press against the elastic pieces 16, and the elastic pieces 16 shift away from the power receiving cavity 142 and drive the free ends 222 of the contacting portions 221 close to the corresponding inner walls of the power receiving cavity 142.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a mating face, a rear face opposite to the mating face, and a receiving cavity between and running through the mating face and the rear face;

a pair of contacts retained in two opposite sides of the receiving cavity and each defining a contacting portion, a retaining portion extending backward from the contacting portion and at least a terminal portion extending from the contacting portion; wherein a pair of elastic pieces integrally extend backward from the mating face of the insulative housing to the receiving cavity, free ends of the contacting portions resist on the elastic pieces, and the elastic pieces shift away from the receiving cavity under condition that a mating electrical connector is inserted in the receiving cavity and press against the elastic pieces, wherein the contacts are wider than the elastic pieces.

2. The electrical connector as claimed in claim 1, wherein the elastic pieces are in the middle of the mating face.

3. The electrical connector as claimed in claim 2, wherein each contact includes a plurality of terminal portions for soldering.

4. The electrical connector as claimed in claim 3, wherein the terminal portions of the contacts are in two rows in a front-to-rear direction.

5. The electrical connector as claimed in claim 4, wherein the terminal portions are perpendicular with the contacting portions.

6. An electrical connector comprising:

a unitary elongated housing extending along a longitudinal direction with a plurality of mating ports divided by corresponding partition grooves and communicating with an exterior along a front-to-back direction perpendicular to said longitudinal direction;

each of said mating ports defining a receiving cavity therein;

each of said partition grooves communicating with the exterior not only forwardly in the front-to-back direction but also up and down in a vertical direction perpendicular to both said longitudinal direction and said front-to-back direction;

in each mating port, two rows of contacts disposed in the housing, each of the contacts defining a front contacting section and a rear mounting section under condition that the contacting sections are located by opposite upper and lower sides of the corresponding receiving cavity; wherein the contacts in each row are unified as one piece including the front contacting sections while the rear mounting sections are still separated from one another for mounting to corresponding through holes in a printed circuit board on which the housing is seated.

* * * * *